United States Patent [19]

Ghandehari

[11] Patent Number: 4,834,812

[45] Date of Patent: May 30, 1989

[54] METHOD FOR PRODUCING POLYMER-BONDED MAGNETS FROM RARE EARTH-IRON-BORON COMPOSITIONS

[75] Inventor: Mohammad H. Ghandehari, Brea, Calif.

[73] Assignee: Union Oil Company of California, Los Angeles, Calif.

[21] Appl. No.: 115,829

[22] Filed: Nov. 2, 1987

[51] Int. Cl.[4] ..... H01F 1/06

[52] U.S. Cl. ..... 148/101; 148/103; 148/105; 148/302

[58] Field of Search ..... 148/101, 103, 105, 302

[56] References Cited

U.S. PATENT DOCUMENTS 4,747,874 5/1988 Ghandehari ..... 75/255

FOREIGN PATENT DOCUMENTS 208807 1/1987 European Pat. Off. ..... 148/302
231620 8/1987 European Pat. Off. ..... 148/101
152007 8/1985 Japan .
194502 10/1985 Japan ..... 148/101

*Primary Examiner*—L. Dewayne Rutledge
*Assistant Examiner*—George Wyszomierski
*Attorney, Agent, or Firm*—Alan H. Thompson; Gregory F. Wirzbicki

[57] ABSTRACT

Permanent magnets are prepared by a method comprising mixing a particulate rare earth-iron-boron alloy with a particulate additive metal powder, compacting the aligned mixture to form a shape, and heating the compacted shape at a temperature at least 150° C. less than the sintering temperature of a rare earth-iron-boron alloy and usually in the range from about 700° C. to less than 850° C.

30 Claims, No Drawings

METHOD FOR PRODUCING POLYMER-BONDED MAGNETS FROM RARE EARTH-IRON-BORON COMPOSITIONS

INTRODUCTION TO THE INVENTION

The invention pertains to powder metallurgical compositions and methods for preparing rare earth-iron-boron powder compositions or permanent magnets, and to polymer-bonded magnets prepared by such methods.

Permanent magnets (those materials which exhibit permanent ferromagnetism) have, over the years, become very common, useful industrial materials. Applications for these magnets are numerous, ranging from audio loudspeakers to electric motors, generators, meters, and scientific apparatus of many types. Research in the field has typically been directed toward developing permanent magnet materials having ever-increasing strengths, particularly in recent times, when miniaturization has become desirable for computer equipment and many other devices.

The more recently developed, commercially successful permanent magnets are produced by powder metallurgical sintering techniques, from alloys of rare earth metals and ferromagnetic metals. The most popular alloy is one containing samarium and cobalt, and having an empirical formula $SmCo_5$. Such magnets also normally contain small amounts of other samarium-cobalt alloys, to assist in fabrication (particularly sintering) of the desired shapes.

Samarium-cobalt magnets, however, are quite expensive, due to the relative scarcity of both alloying elements. This factor has limited the usefulness of the magnets in large volume applications such as electric motors, and has encouraged research to develop permanent magnet materials which utilize the more abundant rare earth metals, which generally have lower atomic numbers and less expensive ferromagnetic metals. The research has led to very promising compositions which contain neodymium, iron, and boron in various proportions. Progress, and some predictions for future utilities, are given for compositions described as $R_2Fe_{14}B$ (where R is a light rare earth) by A. L. Robinson, "Powerful New Magnet Material Found," *Science*, Vol. 223, pages 920–922 (1984).

Certain of the compositions have been described by M. Sagawa, S. Fujimura, N. Togawa, H. Yamamoto, and Y. Matsuura "New Material for Permanent Magnets on a Base of Nd and Fe," *Journal of Applied Physics*, Vol. 55, pages 2083–2087 (1984). In this paper, crystallographic and magnetic properties are reported for various $Nd_xB_yFe_{100-x-y}$ compositions, and a procedure for preparing permanent magnets from powdered $Nd_{15}Fe_{77}B_8$ is described. The paper discusses the impairment of magnetic properties which is observed at elevated temperatures and suggests that additions of small amounts of cobalt to the alloys can be beneficial in avoiding this impairment.

Additional information about the compositions is provided by M. Sagawa, S. Fujimura, H. Yamamoto, Y. Matsuura, and K. Hiraga, "Permanent Magnet Materials Based on the Rare Earth-Iron-Boron Tetragonal Compounds," *IEEE Transactions on Magnetics*, Vol. MAG-20, Sept. 1984, pages 1584–1589. Small substitutions of terbium or dysprosium for neodymium are said to increase the coercivity of sintered neodymium-iron-boron magnets; a comparison is made between Nd15$Fe_{77}B_8$ and Nd13 5$Dy_{1.5}Fe_{77}B_8$ magnets Further instruction concerning the fabrication of rare earth-iron-boron magnets is given by M. Sagawa, S. Fujimura, and Y. Matsuura in European Patent Application No. 83106573.5 and 83107351.5 (filed, respectively, on July 5, 1983 and July 26, 1983), wherein the coercivity-enhancing effect of adding various metallic elements to the magnet alloys is discussed.

C. Herget, in a paper entitled "Metallurgical Ways to NdFeB Alloys. Permanent Magnets From Co-Reduced NdFeB," presented at the 8th International Workshop on Rare-Earth Magnets and their Applications, Dayton, Ohio, May 6–8, 1985, also discusses the addition of other metals to neodymium-iron-boron alloys.

A preferred method of processing such rare earth-iron-boron alloys to make magnets is melt spinning. Meltspinning entails casting a stream of molten alloy onto the perimeter of a rotating chill disk to very rapidly quench the alloy into thin ribbon. The rate of solidification is controlled by regulating the wheel speed to create magnetic domain or smaller sized crystallites in the ribbons as quenched.

In order to make polymer-bonded magnets from meltspun alloy ribbon, it is necessary to break the friable ribbon into small pieces and then to compact the pieces under high pressure into desired magnet shapes. The voids of the compact are typically filled with a liquid polymer such as epoxy and the like to form compacted particle magnets often called "polymer-bonded magnets."

Another method for preparing polymer-bonded magnets is to mix an unsintered magnetizable alloy powder, aluminum, dysprosium, gallium, such as the cobalt-rare earth alloy disclosed in U.S. Pat. No. 4,290,826 issued to Clegg, with a polymer that melts at low temperatures and then hot press or injection mold the mixture to make a magnet shape. Disadvantages of this method are (1) such polymer-bonded magnets are not suited for temperatures much above the glass transition temperature of the polymer, and (2) a substantial amount of non-magnetic polymer dilutes the magnetic constituent. The resulting low density of such magnets is reflected in the comparatively low magnetic strengths obtained. An approach to resolving the dilution problem of the polymer-bonded magnets is to improve the magnetic properties of the unsintered magnetizable alloy powders mixed with the polymers.

Accordingly, the search continues for unsintered magnetizable alloy powder compositions useful in a method for preparing polymer-bonded magnets. More particularly, the search continues for unsintered magnetizable rare earth-iron-boron powder compositions having improved magnetic properties and are useful in the preparation of polymerbonded magnets. Also, improved methods for preparing such unsintered magnetizable rare earth-iron-boron powder compositions are desired.

SUMMARY OF THE INVENTION

One aspect of the invention is a method for producing rare earth-iron boron permanent magnets, comprising the steps of: (1) mixing a particulate alloy containing at least one rare earth metal, iron, and boron, with at least one particulate additive metal having a melting temperature less than about 800° C., such as magnesium, terbium, thallium, tin and zinc, and (2) heating the mixture of alloy and additive metal at a temperature in the range from about 700° C. to less than 850° C., a temperature at least 150° C. less than the sintering temperature, to produce crushable heat-treated compact compositions having magnetic properties. The heat-treated compact compositions contain less than 5 weight percent of the additive metal in combination with rare earth, iron and boron metal. The heat-treated compact compositions are typically crushed to produce a heat-treated compact powder composition. Optionally, the magnetic remains of the mixture of additive metal and alloy or the crushed heat-treated compact powder composition may be aligned in a magnetic field. The heat-treated compact powder composition may be magnetized and employed as an unsintered permanent magnet. However, it is preferred that the heat-treated compact powder composition be mixed with at least one polymer-containing bonding agent to produce a polymer-bonded magnet.

DETAILED DESCRIPTION OF THE INVENTION

As used herein, the term "rare earth" includes the lanthanide elements having atomic numbers from 57 through 71, plus the element yttrium, atomic number 39, which is commonly found in certain lanthanide-containing ores and is chemically similar to the lanthanides.

The term "heavy lanthanide" is used herein to refer to those lanthanide elements having atomic numbers 63 through 71 excluding the "light rare earths" with atomic numbers 62 and below.

"Ferromagnetic metals" include iron, nickel, cobalt, and various alloys containing one or more of these metals. Ferromagnetic metals and permanent magnets exhibit the characteristic of magnetic hysteresis, wherein plots of induction versus applied magnetic field strengths are hysteresis loops.

Points on the hysteresis loop which are of particular interest for the present invention lie within the second quadrant, or "demagnetization curve," since most devices which utilize permanent magnets operate under the influence of a demagnetizing field. On a loop which is symmetrical about the origin, the value of field strength (H) for which induction (B) equals zero is called coercive force ($H_c$). This is a measure of the quality of the magnetic material. The value of induction where applied field strength equals zero is called residual induction ($B_r$). Values of H will be expressed in Oersteds (Oe), while values of B will be in Gauss (G). A figure of merit for a particular magnet shape is the energy product, obtained by multiplying values of B and H for a given point on the demagnetization curve to obtain the largest area under the demagnetization curve. The property is expressed in Gauss-Oersteds (GOe). When these unit abbreviations are used, the prefix "K" indicates multiplication by $10^3$, while "M" indicates multiplication by $10^6$. When the energy products are plotted against B, one point ($BH_{max}$) is found at the maximum point of the curve; this point is also useful as a criterion for comparing magnets. Intrinsic coercivity ($iH_c$) is found where (B-H) equals zero in a plot of (B-H) versus H.

The present invention is a method for preparing permanent magnets, particularly polymer-bonded magnets, based upon rare earth-iron-boron alloys. The invention also includes heat-treated compact compositions prepared in the method and the magnets prepared therefrom. This method comprises mixing a particulate rare earth-iron-boron alloy with at least one particulate additive metal having a melting temperature less than about 800° C. and ordinarily selected from the group consisting of aluminum, dysprosium, gallium, magnesium, terbium, thallium, tin and zinc, before magnetic domain alignment, shape-forming, and heating steps are undertaken.

Copending U.S. patent application Ser. No. 745,293, filed June 14, 1985 and Ser. No. 045, filed May 30, 1986 by the present inventor and incorporated herein by reference, describe an improvement in coercivity which is obtained in rare earth-iron-boron permanent magnets, by a method which involves the addition of a particulate rare earth oxide and/or particulate aluminum to alloy powders, before forming sintered magnets. The methods are exemplified by neodymium-iron-boron magnet compositions and are found to be particularly effective when particulate aluminum metal or rare earth compounds, such as $Gd_2O_3$, $TbO_7$, $Dy_2O_3$ and $Ho_2O_3$, are used as additives.

Suitable rare earth-iron-boron alloys for use in this invention include those discussed in the previously noted paper by Robinson ($R_2Fe_{14}B$), those by Sagawa et al. ($R_{15}Fe_{77}B_8$), as well as others in the art, particularly those having relative weight percentages of rare earth metals between $R_2Fe_{14}B$ and $R_{15}Fe_{77}B_8$. Magnets currently being developed for commercialization generally are based upon neodymium-iron-boron alloys, but the present invention is also applicable to alloy compositions wherein one or more other rare earths, particularly those considered to be light rare earths, replaces all or some fraction of the neodymium. In addition, a portion of the iron can be replaced by one or more other ferromagnetic metals, such as cobalt.

The alloys can be prepared by several methods, with the most simple and direct method comprising melting together the component elements, e.g., neodymium, iron, and boron, in the correct proportions. Prepared alloys are usually subjected to sequential particle size reduction operations, preferably sufficient to produce particles of less than about 200 mesh (0.075 millimeter diameter).

To the magnet alloy powder is added a powder of at least one particulate additive metal having a melting temperature less than 850° C. The additive metal is typically selected from the group consisting of aluminum, dysprosium, gallium, magnesium, terbium, thallium, tin and zinc, preferably having particle sizes and distributions similar to those of the alloy. Preferred additive metals include aluminum, gallium, tin and zinc, with aluminum being most preferred. The additive metal, or metals, can be mixed with the alloy after the alloy has undergone particle size reduction, or can be added during size reduction, e.g., while the alloy is present in a ball mill.

The alloy and additive metal(s) are thoroughly mixed and this mixture is heated to prepare a heat-treated compact composition having magnetic properties. The heat-treated compact composition may be subjected to a magnetic field, by use of, for instance, a pulse magnetizer. The magnetized heat-treated compact composition may be employed as an unsintered permanent magnet.

By the method of the invention the heat-treated compact composition is preferably crushed to produce a heat-treated compact powder composition of the invention having magnetic properties, and having grain sizes less than 25 microns and usually in the range from about 5 to about 15 microns Such grain sizes are typically multi-domains. Prior to heating, the powder mixture of alloy and additive metal may be placed in a magnetic field to align the crystal axes and magnetic domains, and preferably simultaneously with a compacting step, in which a shape is formed from the powder mixture The compacted shape is then heated to form the heat-treated compact composition having suitable mechanical integrity but easily crushable, under conditions of vacuum or an inert atmosphere (such as argon).

A critical feature of the invention is the heating temperature of the mixture of alloy and additive metal during the preparation of the heat-treated compact composition. Ordinarily the heating temperature required to sinter mixtures of rare earth, iron and boron metals together with other components is at least about 1000° C. and typically greater than 1070° C. to prepare sintered permanent magnets. In the present invention, the mixture of rare earth-iron-boron alloy and additive metals is heated to a temperature in the range from about 700° C. to less than 850° C., a temperature at least 150° C. less than the sintering temperature. Preferably, the heating temperature is in the range from about 725° C. to about 825° C. to produce the heat-treated compact composition.

Enhanced coercivities are observed in heat-treated compact powder compositions of the invention which have at least one additive metal in amounts about 0.05 to about 1 weight percent of the heat-treated compact composition or the heat-treated compact powder composition produced therefrom. A particular advantage from the addition of particulate additive metal, according to the present invention, is an ability to obtain increases in coercivity with small quantities of additive metal.

At least a portion of the rare earth-iron-boron alloy in the powder mixture with the additive metal ordinarily begins to change from a solid phase to a liquid phase at a temperature greater than about 550° C. The additive metals employed herein melt at temperatures less than about 800° C. and readily mix with a liquid phase of the alloy.

By use of the invention particles of the heat-treated compact powder compositions are bound in a desired shape by being thoroughly mixed with a polymer-containing bonding agent to produce a polymer-bonded magnet. For example, a polymer-containing bonding agent such as dry epoxy is ground to a fine powder, mixed with a catalyst at a temperature below the activation temperature of the catalyst, milled with the catalyst to fine powder particles having diameters less than 25 microns and preferably in the range from 1–15 microns and then mixed with the heat treated compact powder composition of the invention. The mixture of powders, i.e. the heat-treated compact powder composition of the invention blended with the polymer-containing bonding powder, is compacted under elevated pressure and may be placed in a magnetic field to align the magnetic domains in the same manner as in the preparation of the heat-treated compact compositions of the invention discussed hereinbefore. After compaction of the heat-treated compact powder composition with the polymer-containing bonding agent, the resultant compact undergoes curing treatment that effects the bonding of the heat-treated compact powder particles of the invention with the polymer to produce he desired polymer-bonded magnet. In the case of an epoxy resin bonding agent, the resultant compact is heated to a temperature sufficient to cure the polymer contained therein. The temperature is sufficiently high enough (typically up to about 150° C. for less than one hour) to activate the catalyst and cure the epoxy resin polymer. Such polymer-bonded compositions may be magnetized during or after such curing treatment.

Polymers contained in the bonding agents may be inorganic or organic. Inorganic agents includes polymers such as siloxane, sulfur chains, black phophorus, boron-nitrogen and silicones. Organic agents may contain natural, synthetic and/or semisynthetic polymers. For example, natural and synthetic rubber, and both thermoplastic and thermosetting synthetic polymers may be used. Specific polymers useful herein include elastomers (unvulcanized or vulcanized), nylon, polyvinyl chloride, polyethylene (linear), polystyrene, polypropylene, fluorocarbon resins, polyurethane, acrylate resins, polyethylene (crosslinked), phenolics, alkyds, polyesters, and cellulosics (rayon, methylcellulose, cellulose acetate).

Different polymer-containing bonding agents combined with the heat-treated compact powder composition of the invention may require different preparational methods. Furthermore, the heat-treated compact powder of the invention may be mixed with any proportion of the polymer-containing bonding agent depending upon the agent employed and/or the desired application. Accordingly, the resulting polymer-bond magnet may be "magnet rich," containing greater than 50 weight percent of the heat-treated compact powder or may be "magnet lean," containing less than 50 percent of the heat-treated compact powder, with the remainder of the resultant magnet being polymer binder. The polymer-bonded magnets obtained, whether flexible-bonded or rigid-bonded types, have increased coercivity compared to corresponding comparable compositions prepared without the aforementioned additive metal powders.

The invention is further illustrated by the following example which is illustrative of specific modes of practicing the invention and is not intended as limiting the scope of the appended claims. In the example, all percentage compositions are expressed on a weight basis

EXAMPLE

An alloy having the nominal composition 33.5% Nd-65.2% Fe-1.3% B (approximately $Nd_{15}Fe_{77}B_8$) is prepared by melting together elemental neodymium, iron and boron in an induction furnace, under an argon atmosphere. The alloy is cooled, crushed by hand tools to particle sizes less than about 70 mesh (0.2 millimeters diameter), and attritor-milled under an argon atmosphere, in an organic liquid, to obtain a majority of particle diameters about 5 to 10 micrometers in diameter. After drying under a vacuum, the alloy powder (nominal composition $Nd_{15}Fe_{77}B_8$) is ready for use to prepare magnets.

Samples of the alloy powder are used to prepare Magnets A, B, C and D using the following procedure:

(1) magnetic domains and crystal axes of the alloy powder are aligned by a vertical field of about 7 kOe while the powder is being compacted loosely in a die, than the pressure on the die is increased to about 70,000 p.s.i.g. for 30 seconds;

(2) the compacted powder compositions obtained in step (1) are heated under argon at the indicated temperatures in Table 1 for four hours (except the green compact for Magnet A which is heated for 1 hour) and then rapidly moved into a cool portion of the furnace and allowed to cool to room temperature; and (3) the heat-treated compact powder compositions obtained in step (2) are magnetized in a pulsed magnetizing field of about 70 kOe.

Reference Magnet R is prepared in the same manner as above except step (2) is not performed, i.e., compacted green magnet is not heated above room temperature.

Properties of the prepared Magnets A, B, C, D and R are summarized in Table 1. These data indicate that when the compacted green magnets are heated to temperature from about 700° C. up to less than 850° C. coercivity of a neodymium-iron-boron magnet significantly improves.

An alloy used in the preparation of Magnets E, F and G, also shown in Table 1 and having the nominal composition 33.5% Nd-65.2% Fe-1.3% B (approximately $Nd_{15}Fe_{77}B_8$), is prepared by melting together elemental neodymium, iron, and boron in an induction furnace, under an argon atmosphere After the alloy is allowed to solidify, it is heated at about 1070° C. for about 96 hours to permit remaining free iron to diffuse into other alloy phases which are present. In the same manner as employed to prepare the alloy powder for Magnets, R, A, B, C and D above, the alloy is cooled, crushed to particle sizes less than about 70 mesh (0.2 millimeters diameter), and attritor-milled under an argon atmosphere, in an organic liquid, to obtain a majority of particle diameters about 5 to 10 microns in diameter. After drying under a vacuum, the alloy powder $Nd_{15}Fe_{77}B_8$ is ready for use to prepare Magnets E, F and G.

Samples of the alloy powder are used to prepare Magnets E, F and G using the following procedure:

(1) aluminum and aluminum oxide powder ($Al_2O_3$) are weighed and added to a weighed amount of alloy powder in the preparation of Magnets E and F, respectively, and the mixture is vigorously shaken in a glass vial by hand for a few minutes, to intimately fix the components (no additives are added in the preparation of Magnet E);

(2) magnetic domains and crystal axes are aligned by a vertical field of about 7 kOe while the powder mixture is being compacted loosely in a die, then the pressure on the die is increased to about 70,000 p.si.g. for 30 seconds;

(3) the compacted powder compositions obtained in step (2) are heated under argon at the indicated temperatures in Table 1 for four hours and then rapidly moved into a cool portion of the furnace and allowed to cool to room temperature; and (4). the heat-treated compact powder compositions obtained in step (3) are magnetized in a pulsed magnetizing field of about 70 kOe.

Properties of the prepared Magnets E, F and G are summarized in Table 1. These data indicate that an aluminum metal additive significantly improves coercivity of a neodymium-iron-boron magnet. Aluminum metal, having a melting temperature less than 800° C., is representative of metals effective for improving coercivity during the preparation of unsintered magnets. These data also indicate that a nonmetallic material such as aluminum oxide ($Al_2O_3$), having a melting temperature greater than about 800° C., is not effective for improving such coercivities. Thus, the term "additive metal", as used herein, refers to the metal element per se, as opposed to compounds thereof.

TABLE 1

| Magnet No. | Heating Temperature °C. | Heat Time (hours) | Additive | $B_r$ (Gauss × $10^3$) | $H_c$ (Oersted × $10^3$) | $iH_c$ (Oersted × $10^3$) |
|---|---|---|---|---|---|---|
| R | none | — | none | 2.6 | 1.0 | 1.4 |
| A | 680 | 1 | none | 1.0 | 0.2 | 0.2 |
| B | 700 | 4 | none | 6.3 | 3.5 | 4.4 |
| C | 800 | 4 | none | 6.9 | 3.1 | 4.1 |
| D | 850 | 4 | none | 6.9 | 2.5 | 3.1 |
| E | 800 | 4 | none | 6.7 | 3.6 | 4.6 |
| F | 800 | 4 | Al | 6.7 | 4.4 | 5.6 |
| G | 800 | 4 | $Al_3O_3$ | 5.5 | 2.6 | 3.6 |

Although particular embodiments of the invention have been described, it will be understood, of course, that the invention is not limited thereto since many obvious modifications can be made, and it is intended to include within this invention any such modifications as will fall within the scope of the appended claims.

I claim:

1. A method for producing a permanent magnet, comprising the steps of:

(a) mixing a particulate alloy, containing at least one rare earth metal, or in, and boron, with at least one particulate additive metal having a melting temperature less than about 800° C.

(b) compacting the mixture to form a shape, (c) heating the compacted shape at a temperature in the range from about 700° C. to less than 850° C. to form a heat-treated compact composition having magnetic properties, and (d) crushing said heat-treated compact composition obtained from step (c) to produce a heat-treated compact powder composition having grain sizes of diameter less than 25 microns.

2. The method defined in claim 1 wherein said particulate additive metal is selected from the group consisting of aluminum, dysprosium, gallium, magnesium, terbium, thallium, tin and zinc.

3. The method defined in claim 1 wherein said heating temperature is in the range from about 725° C. to 825° C.

4. The method defined in claim 1 wherein said particulate additive metal is aluminum.

5. The method defined in claim 1 wherein said rare earth metal comprises a light rare earth.

6. The method defined in claim 5 wherein said rare earth metal comprises neodymium.

7. The method defined in claim 1 further comprising, prior to step (b), aligning magnetic domains of the mixture in a magnetic field and, after step (c), magnetizing said heat-treated compact composition obtained in step (b).

8. A permanent magnet prepared according to the method of claim 7.

9. The method defined in claim, 1 wherein said heat-treated compact composition contains about 0.05 to about 1.0 weight percent of said additive metal.

10. The method defined in claim 1 wherein said heating temperature is at least 150° C. less than the temperature required to produce a sintered permanent magnet from said mixture obtained in step (a).

11. The method defined in claim 1 wherein said particulate alloy is sintered prior to step (a).

12. The method defined in claim 1 wherein said alloy further contains a ferromagnetic metal selected from the group consisting of nickel, cobalt, and mixtures thereof.

13. The method defined in claim 1 wherein, prior to step (a), said particulate alloy is prepared by mixing a rare earth-iron-boron alloy with at least one particulate rare earth oxide, rare earth metal or aluminum metal, followed by sintering the mixture to a temperature greater than about 1070° C.

14. The method defined in claim 13 wherein the rare earth oxide is selected from the group consisting of terbium oxide and dysprosium oxide and mixtures thereof.

15. The method defined in claim 1 further comprising the steps of:

(e) aligning magnetic domains of the heat-treated compact powder composition obtained from step (d), (f) mixing said heat-treated compact powder composition with a polymer-containing bonding agent having particle sizes of diameter less than 25 microns, (g) compacting the mixture obtained from step (f), and (h) treating the compact obtained from step (g) to effect bonding of the particles of the heat-treated compact powder composition with the polymer contained in said polymer-containing bonding agent and magnetizing said compact.

16. A polymer-bonded permanent magnet prepared according to the method of claim 15.

17. The magnet defined in claim 16 wherein said polymer-bonded magnet comprises flexible-bonded magnets or rigid-bonded magnets.

18. The method defined in claim 1 further comprising the step of:

(e) aligning magnetic domains of the heat-treated compact powder composition obtained in step (d) and magnetizing said heat-treated compact powder composition.

19. A permanent magnet prepared according to the method of claim 18.

20. A method for producing a permanent magnet, comprising the steps of:

(a) mixing a particulate alloy containing neodymium, iron and boron, with a particulate additive metal selected from the group consisting of aluminum, dysprosium, gallium, magnesium, terbium, thallium, tin and zinc, (b) compacting the mixture to form a shape, (c) heating the compacted shape at a temperature in the range from about 700° C. to less than 850° C., and (d) crushing the heat-treated compact composition obtained in step (c) to form a heat-treated compact powder composition having grain sizes of diameter less than 25 microns.

21. The method defined in claim 20 wherein said additive metal is selected from the group consisting of aluminum, gallium, tin and zinc.

22. The method defined in claim 20 wherein said rare earth metal comprises neodymium.

23. The method defined in claim 20 wherein said heat-treated compact composition contains about 0.05 to about 1.0 weight percent of said additive metal.

24. The method defined in claim 20 wherein said heating temperature is at least 150° C. less than the temperature required to produce a sintered permanent magnet for said mixture obtained in step (a).

25. The method defined in claim 20 wherein said particulate alloy is sintered prior to step (a).

26. The method defined in claim 20 wherein the alloy further contains a ferromagnetic metal selected from the group consisting of nickel, cobalt, and mixtures thereof.

27. The method defined in claim 20 wherein, prior to step (a), said particulate alloy is prepared by mixing a rare earth-iron-boron alloy with at least one particulate rare earth oxide, rare earth metal or aluminum metal followed by sintering the mixture to a temperature greater than about 1070° C.

28. The method defined in claim 20 further comprising the steps of:

(e) aligning magnetic domains of the heat-treated compact powder composition obtained from step (d), (f) mixing said heat-treated compact powder composition with a polymer-containing bonding agent having particle sizes of diameter less than 25 microns, (g) compacting the mixture obtained from step (f), and (h) treating the compact obtained in step (g) to effect bonding of the particles of said heat-treated compact powder composition with the polymer contained in said polymer-containing bonding agent and magnetizing said compact.

29. A polymer-bonded permanent magnet prepared according to the method of claim 28.

30. The magnet defined in claim 29 wherein said polymer-bonded magnet comprises flexible-bonded magnets or rigid-bonded magnets.

* * * * *